United States Patent [19]

Chien

[11] Patent Number: 4,574,721

[45] Date of Patent: Mar. 11, 1986

[54] ASSEMBLY FOR HOLDING CARGO

[76] Inventor: Chung Min Chien, No. 69, Kou Jung Rd., I-Lan, Taiwan

[21] Appl. No.: 680,943

[22] Filed: Dec. 12, 1984

[51] Int. Cl.[4] ..... B63B 3/00; B63B 11/00

[52] U.S. Cl. ..... 114/72; 114/74 R; 414/137; 414/140

[58] Field of Search ..... 414/137, 139, 140, 468; 114/72, 73, 74 R, 59; 105/358, 359, 360; 220/1 B, 1 V, 5 A, 22.1, 855

[56] References Cited

U.S. PATENT DOCUMENTS 2,825,478 3/1958 Hunnicut et al. ..... 441/468

FOREIGN PATENT DOCUMENTS 667692 7/1935 Fed. Rep. of Germany ..... 414/468

1366545 12/1964 France ..... 114/72

*Primary Examiner*—Galen L. Barefoot

*Assistant Examiner*—Edwin L. Swinehart

*Attorney, Agent, or Firm*—McGlew and Tuttle

[57] ABSTRACT

An assembly for carrying cargo which comprises a cylindrical tank rotatable about a horizontal axis and having a torque partition member dividing it into an upper and a lower compartment, rotating rails provided around the periphery of the tank, support rails for guiding and supporting the rotating rails, and means for locking the tank against movement. The compartments of the tank are connected to cargo pipes and gas pipes through a connecting means associated with each tank. A liquid cargo can be loaded in the upper compartment simultaneously with the unloading of the liquid cargo from the lower compartment and the loaded upper compartment can be placed in a lower level position by the rotation of the tank caused by a torque produced by the partition member during loading and unloading.

14 Claims, 35 Drawing Figures

ASSEMBLY FOR HOLDING CARGO

BACKGROUND OF THE INVENTION

This invention relates to a tanker, particularly to a cargo tank which is cylindrical and rotatable about a horizontal axis and has a torque partition member dividing it into independent upper and lower compartments whereby when a liquid is unloaded from the lower compartment, another liquid can be loaded in the upper compartment and the loaded upper compartment can be changed to the lower level position by the rotation of the tank which is caused by a torque produced by the partition member during loading and unloading.

A tanker transferring crude oil typically includes compartmented tanks for carrying crude oil exclusively and holding ballast water. Since such a tanker carries no cargo on its return passage, it should be provided with ballast water for the stability of the tanker. Therefore, it is not economical.

SUMMARY OF THE INVENTION

An object of the invention is to provide a tank that can carry crude oil to the destination and carry other products on its return passage without causing pollution, for example, fresh water for the Middle East countries.

Another object of the invention is to provide a tank for use in a tanker which can be easily cleaned and from which the cargo can be completely removed.

A further object of the invention is to provide a compartmented tank of improved construction by which the emptied compartment can be changed into a position higher in level than the loaded compartment, thereby preventing the decrease in stability of the ship due to the weight reduction in lower level compartments and eliminating the provision of ballast water in the emptied lower level compartments.

A still further object of the invention is to provide an improved compartmented tank construction which can minimize the pollution of the sea caused by the ballast water.

A still further object of the invention is to provide a cargo tank which can be easily taken out of the ship for replacement or maintenance.

A still further object of the invention is to provide an improved tank construction by which the cargo handling time can be reduced, since the loading and unloading operation can be performed simultaneously.

These and other objects can be achieved in accordance with the invention through the provision of a tank assembly mounted in a bowl-shaped keel of semicircular cross-section and connected to cargo pipes for sending cargo into or out of said assembly and gas pipes for sending gases into or out of said assembly. The assembly comprises: at least one cylindrical tank mounted for rotation about a horizontal axis in the keel and having two closed ends and an inside torque partition member dividing the tank into a lower compartment and an upper compartment; the torque partition member producing a torque during loading and unloading the liquid cargo; rotating rail means provided around the periphery of the rotatable tank; support rail means mounted on the keel for supporting the rotating rail means; means for locking said tank against movement; and two connecting means for respectively connecting said two compartments to the cargo pipe and the gas pipe attached to two closed ends of the tank, each of said means including a double pipe assembly which has an outer pipe and an inside pipe and has its first end attached to the closed end for rotation together with said tank, the annular space between said outer pipe and said inside pipe being used for the flow of the gas and said inside pipe being used for the flow of the liquid cargo, said double pipe assembly having its second end movably connected with said cargo pipe and gas pipe in a gas-tight relationship.

The presently exemplary preferred embodiment will be described in detail with reference to the accompanying drawings, in which:

DETAILED DESCRIPTION OF THE PREFERRED EMBODIMENT

Figure 1:
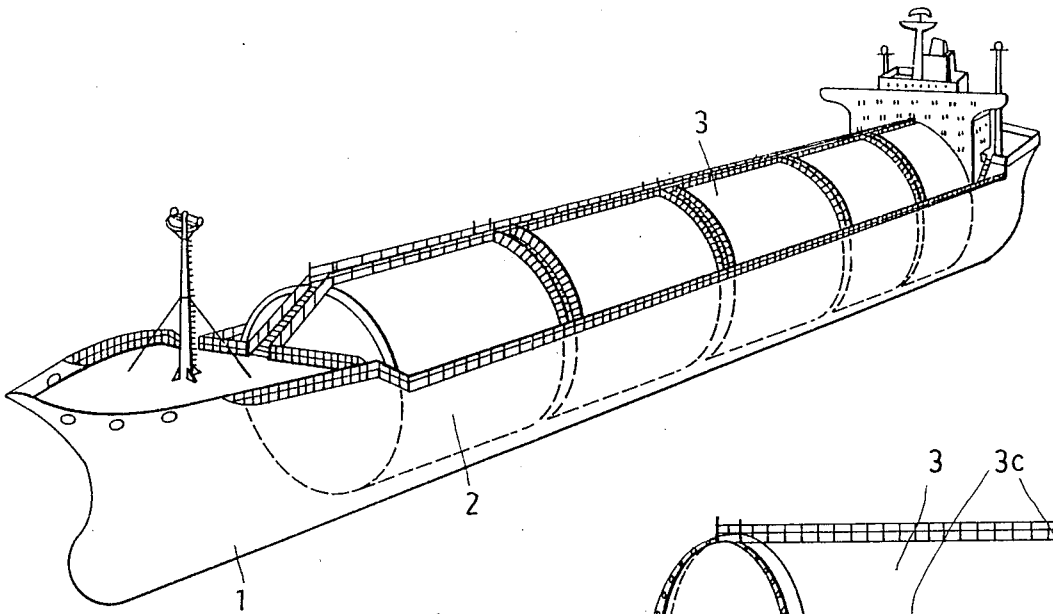
FIG. 1 is a schematic view of a tanker having tanks embodying the present invention.

Referring to FIG. 1 there is shown a tanker 1 which is provided with five rotatable cylindrical closed tanks 2 for carrying bulk cargo such as, grain, liquid or powdered products. The tanks 2 may be of different lengths, but they must be of equal diameter. Each of the tanks 2 is spaced apart from the others and in the space between two tanks is provided a bulkhead ( not shown). There are further provided tank covers 3 for individual tanks 2 and on the covers 3 are provided removable ladders, balusters, fire protecting devices, etc.

Figure 2:
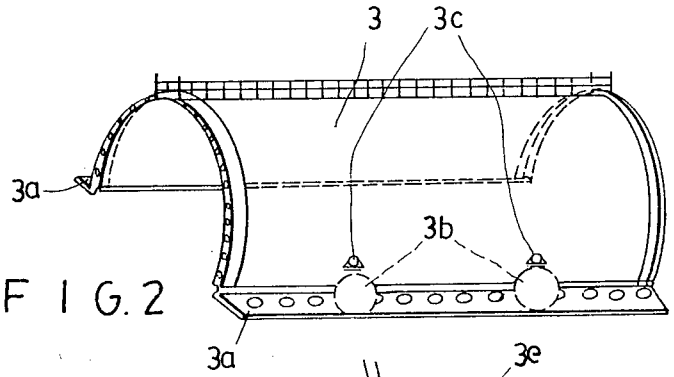
FIG. 2 is a schematic view of a tank cover according to the invention.
Figure 2A:
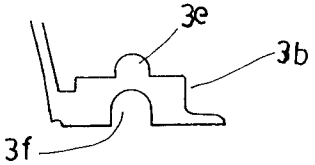
FIG. 2*a* is a schematic view of an anchor according to the invention.

As shown in FIG. 2, each tank cover 3 has two longitudinal flanges 3*a* at its two sides to be secured to the deck by means of bolts. The inner surfaces of the covers 3 are provided with compression rubber rings ( not shown ) on which a lubricating oil is applied. There are further provided four anchor means 3*b* and four hoisting rings 3*c* for each tank cover 3. The anchor means 3*b* may be in the shape, as shown in FIG. 2*a*, having a rounded protrusion 3*e* and a concavity 3*f*. If it is necessary to take out a tank 2 from the ship for maintenance or replacement, the relative cover 3 can be detached from the deck and placed over the adjacent cover 3 from which ladders and balusters are removed. The anchor means 3*b* serves to prevent the movement of the detached cover 3 relative to the adjacent cover 3 by the engagements of the concavity 3*f* of the upper anchor means 3*b* with the rounded protrusions 3*e* of the lower anchor means 3*b*.

Figure 3:
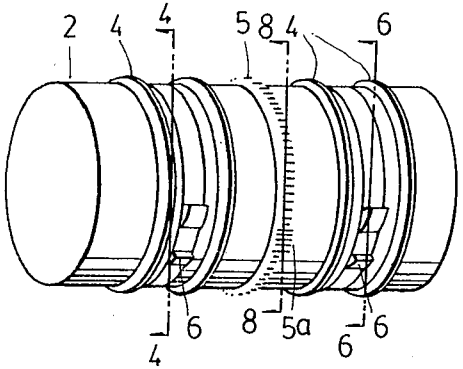
FIG. 3 is a schematic view of a tank according to the invention.
Figure 4:
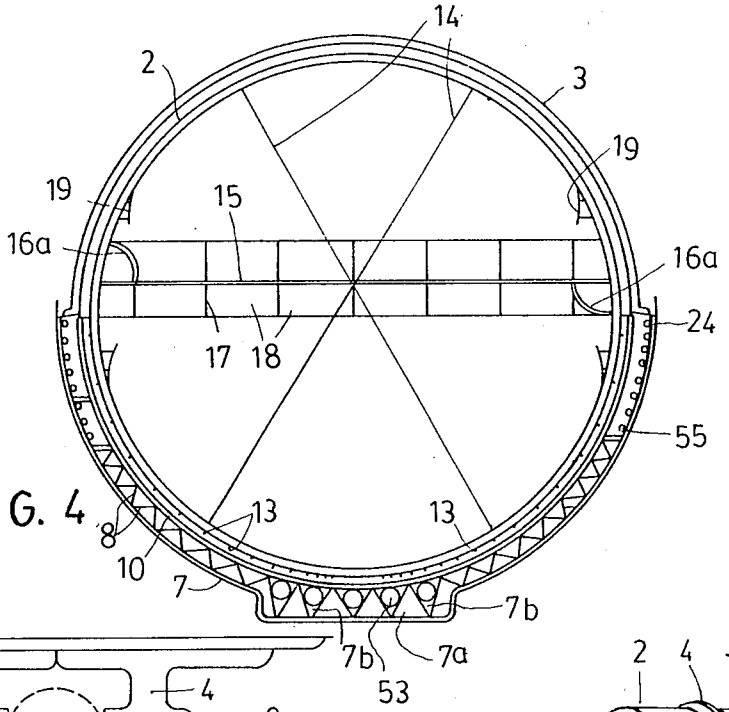
FIG. 4 is a schematic sectioned view taken along the line 4—4 of FIG. 3.

Referring to FIG. 3, each tank 2 is provided with four pairs of rotating rails 4, a gear means 5 and two ratchet assemblies 6 on its periphery. The tanks 2 are rotatably mounted in the space bounded by the tank covers 3 and a bowl-shaped keel 7 of substantially semicircular cross-section which is provided in the ship hull, as shown in FIG. 4. FIG. 4 is a sectioned view of the tank 2 taken along a plane that intersects the tank 2 at a position where a rotating rail 4 exists. It can be seen that, there are provided, on the curved surface of the keel 7, longitudinal ribs 8 extending from one end to another end of the keel 7 and including longitudinal bars juxtaposed each other to form a zigzag shaped arrangement in their cross-sections. The spaces 7*a* defined by the ribs 8 and the keel 7 can be used for holding ballast water or inert gases and the spaces 7*b* defined by the ribs 8 can be used for placing pipelines.

Figure 5:
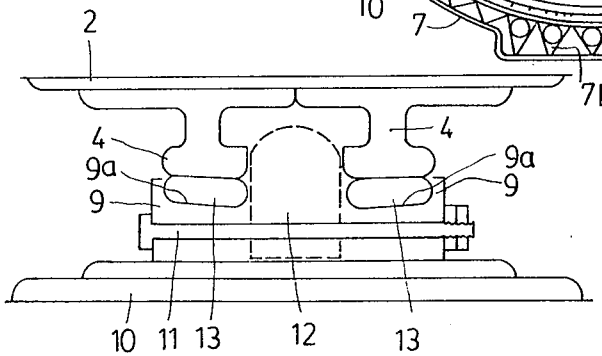
FIG. 5 is an enlarged view illustrating the rotating rail and the support rail.

Between the ribs 8 and the periphery of each tank 2 are provided four pairs of arc-shaped support rails 9 for rotating rails 4 of the tank 2 respectively. Each pair of the arc-shaped support rails 9 is mounted on an arc-shaped base 10 transverse to the keel 7, as shown in FIGS. 4 and 5, and are fastened by bolts 11 which transversely pass through them at certain intervals. Between each pair of support rails 9 are further provided guide rollers 12 rotatable about vertical axes located at regular intervals. Each support rail 9 is provided with recesses 9*a* at certain intervals receiving horizontal rollers 13 for providing rolling contact surfaces with the rotating rail 4. Preferably, the recesses 9*a* are so shaped that the rollers 13 received therein slightly inclined downward on the side near the guide rollers 12 for the sake of positioning the tank 2. The intervals between rollers 13 on two sides of the tank 2 are broader than those at the bottom side of the tank 2, and at the lowest portion of the support rail 9, no rollers 13 are provided. The distribution of the rollers 13 is shown in FIG. 4 by dots which represent the rollers 13. The rotating rails are prevented from slipping out of the way by the guide rollers 12.

Inside each tank 2 are provided pairs of H beams 14 for strengthening the tank wall and a torque partition member 15 for dividing the tank into two independent compartments of equal volume or unequal volume. When a cargo placed in one compartment is unloaded, another cargo can be loaded into the other compartment at the same time. The pairs of H beams 14 are attached to the inner side of the tank wall at the positions corresponding to the positions of the rotating rails 4, gear means 5 and ratchet assemblies 6, and each of the H beams 14 is arranged to have its grooved sides facing the closed ends of the tank 2. The torque partition member 15 is extended from one end to another end of the tank 2, as better shown in FIG. 14. At two opposite sides of the partition member 15 adjacent to the cylindrical wall of the tank 2 are provided two concaved portions 16*a* which define two channels extending end to end of the tank 2. There are further provided two recessed surfaces 16*b* at the opposite ends of the partition member 15 adjacent to the closed ends of the tank 2. At the lower and upper surfaces of the partition member 15 are mounted a plurality of intersecting wash plates 17 and 18 which define a plurality of rectangular compartments to minimize the damage caused by the striking pressure of the moving liquid exerted on the partition member 15. The intersecting plates 17 and 18 are provided with holes for communicating the rectangular compartments. On the inner side of the cylindrical wall of the tank 2 are further provided baffles 19.

Figure 6:
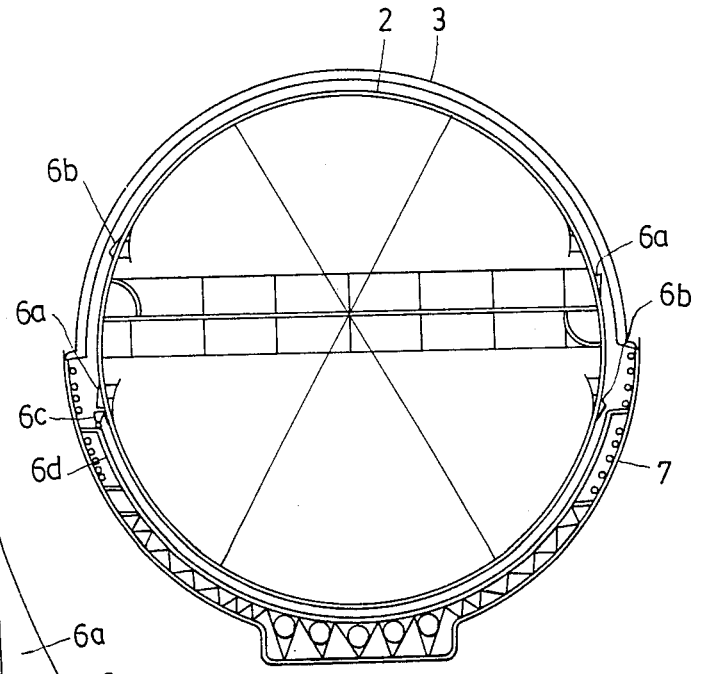
FIG. 6 is a schematic sectioned view taken along the line 6—6 of FIG. 3.
Figure 7:
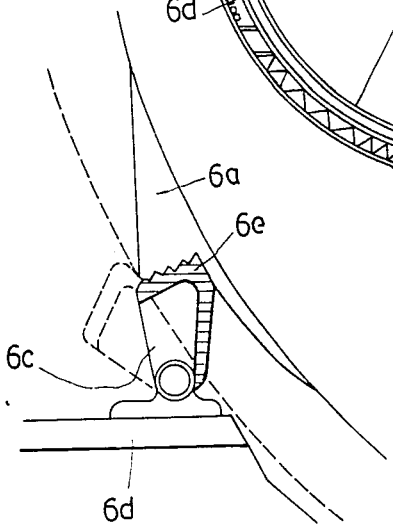
FIG. 7 is an enlarged view showing the pawl and the inclined tooth.

FIG. 6 shows a cross-section of the tank 2 along a plane at a position where the ratchet means 6 exists. The ratchet means 6 includes two diametrically opposite inclined teeth 6*a* and two diametrically opposite inclined teeth 6*b* which are smaller than the teeth 6*a* disposed on the periphery of the tank 2, near the partition member 15, as shown in FIGS. 6 and 7. There are further provided a pawl 6*c* for engaging with the inclined teeth 6*a* and 6*b* which is mounted on an arc-shaped support 6*d* and provided with a rubber pad 6*e*, and an electronic sensing device ( not shown) connected to the pawl 6*c* for producing a signal when the pawl catches one inclined tooth 6*a* or 6*b*. The tank 2 can be locked against movement by the engagement of the pawl 6*c* and one inclined tooth 6*a* when the torque partition member 15 is substantially in a horizontal position.

Figure 8:
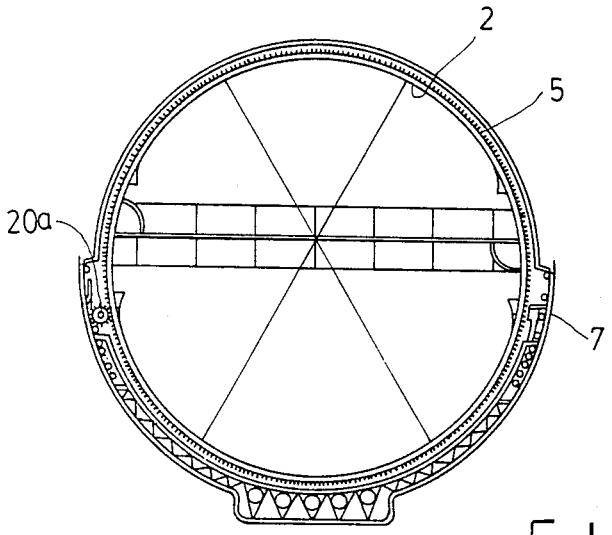
FIG. 8 is a schematic sectioned view taken along the line 8—8 of FIG. 3.
Figure 9:
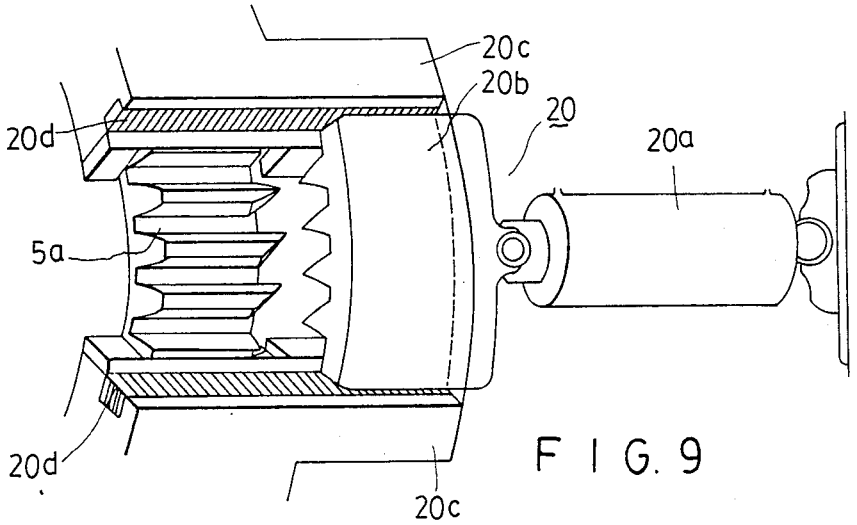
FIG. 9 is an enlarged view showing the hydraulically operated catching member and a locking gear portion of the gear.
Figure 10:
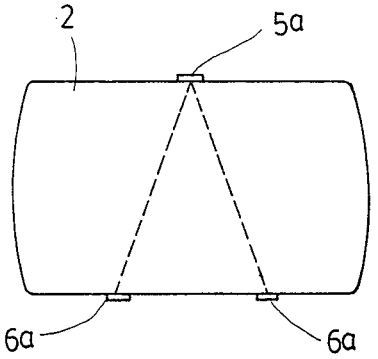
FIG. 10 shows the relative positions of the inclined teeth and the locking gear portion of the gear.
Figure 12:
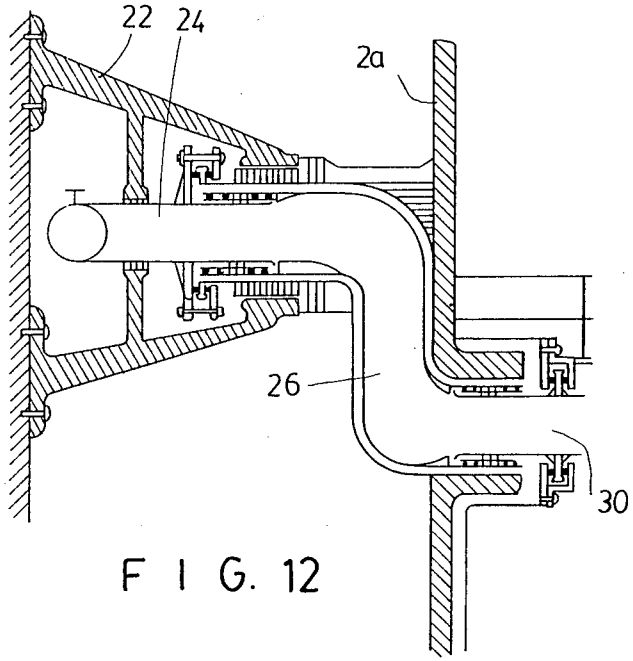
FIG. 12 is a schematic sectioned view showing how a cargo pipe and a gas pipe connected to the tank having two compartments of different volume through a double pipe.

FIG. 8 shows a cross-section of the tank 2 taken along a plane at a position where a peripheral gear means 5 exists. Referring to FIGS. 3, 8 and 9 the peripheral gear 5 is provided on the periphery of the tank at a position intermediate four pairs of rotating rails 4 and has a locking gear portion 5*a* having teeth greater in width than other teeth. There is further provided a hydraulically operated catching member 20 which includes a hydraulic device 20*a* mounted on the keel 7, a toothed member 20*b* connected to the hydraulic device 20*a* for engaging with the locking gear portion 5*a*, and a guide member 20*c* for guiding the toothed member 20*b*. In the guide member 20*c* are provided compression rubber members 20*d* for shock absorption. The positions of the locking gear portion 5*a* and the catching member 20 are so chosen that they will engage with one another when the pawl 6*c* engages with one of the inclined teeth 6*a*. Therefore, when the tank 2 is immobilized, it is locked at three locations at which the portion 5*a* and the two inclined teeth 6*a* of the ratchet assemblies 6 exist and these locations form an isosceles triangle when they are interconnected as shown in FIG. 10. In addition, there are also provided a hydraulically operated motor for driving the tank, a speed change gear assembly to be put into mesh with the gear 5, and speedometer, etc. ( not shown).

There are further provided main cargo pipes and gas pipes for sending cargo and gas in or out of the tank 2.

Figure 11:
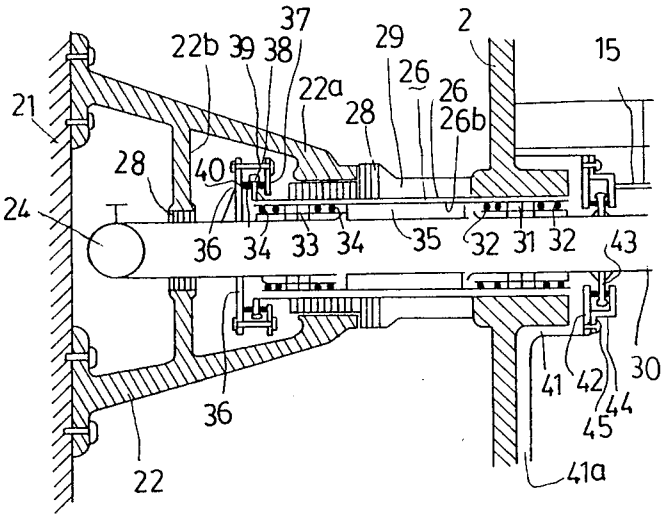
FIG. 11 is a schematic sectioned view showing how a cargo pipe and a gas pipe connected to the tank having two equal compartments through a double pipe.
Figure 13:
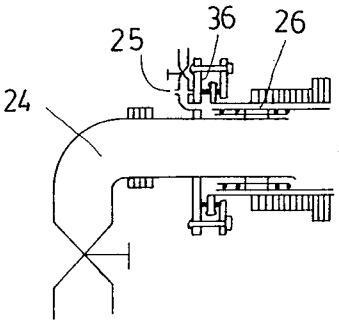
FIG. 13 is a fragmentary top plan view of FIG. 11.
Figure 14:
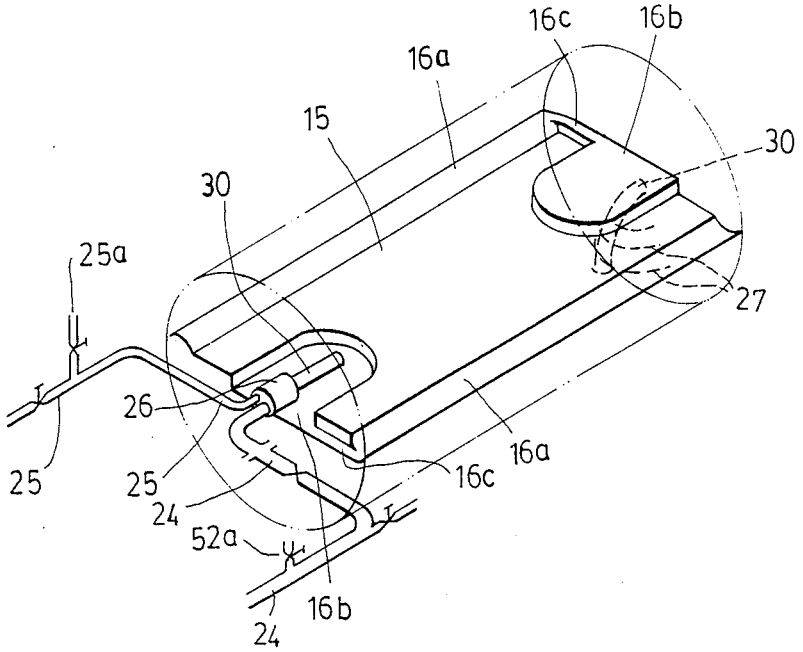
FIG. 14 is a perspective view of a tank with the cargo pipe and the gas pipe.

Referring to FIGS. 11, 13 and 14, there is illustrated how a main cargo pipe 24 and a gas pipe 25 are connected to one compartment of the rotating tank 2 through a connecting means which includes a double-pipe 26 constituted of an outer pipe 26*a* and an inside pipe 26*b*. It is described hereinbefore that there is provided a bulkhead between two tanks 2. As shown in FIG. 11, to the bulkhead 21 is mounted a support 22 for holding the double-pipe 26 and the cargo pipe 24. The support 22 has two clamping members 22*a* for holding one end of the double pipe 26 and two clamping members 22*b* for holding one end of the cargo pipe 24. Numeral 28 represents a rubber ring and numeral 29 represents a spacer. Another end of the double-pipe 26 is fixedly inserted in the closed end 2*a* of the tank 2 for rotation together with the tank 2. A hose 30 which is placed in one compartment of the tank 2 is sealingly and movably inserted in one end of the inside pipe 26*b* by using a bearing assembly 31 and O-rings 32. As shown in FIG. 14, it can be appreciated that the hose 30 is supported in the recess 16*b* of the partition member 15 when it is in the upper compartment, and when the hose 30 is in the lower compartment, it is suspended and is guided by arcuate support rods 27 attached to the closed end of the tank 2 to prevent from collapsing. Referring again to FIG. 11, another end of the inside pipe 26*b* is connected to the cargo pipe 24 by means of a bearing assembly 33 and O-rings 34 so that the inside pipe 26*b* can be moved relative to the cargo pipe 24. The inside pipe 26*b* is further provided with a tubular member 35 welded to the inner side thereof.

There are further provided an annular retainer plate 36 sealingly sleeved onto the cargo pipe 24 and connected to a further retainer plate 37 through clamping screws 38. A flanged ring 39 is attached to one end of the outer pipe 26*a* and is provided with grooves (not shown) for receiving two sealing rings 40 which are in turn clamped by the retainer plates 36 and 37 for providing a gas seal between the retainer plate 36 and the annular space of the double-pipe 26. The retainer plate 36 is further connected to the gas pipe 25, as shown in FIG. 13, thereby achieving a gas tight communication between the gas pipe 25 and the annular space of the double-pipe 26.

Figure 16:
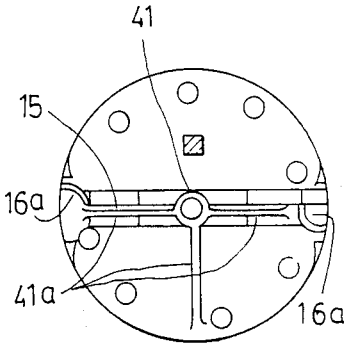
FIG. 16 is an elevation view showing the inner side of the closed end of the tank.

At the end of the double-pipe 26 which is inserted in the tank 2 is provided a tubular member 41 of which one end is attached to the closed end 2*a* of the tank 2 in a gas tight relationship. The other end of the tubular member 41 is provided with an annular end face 42 surrounding the hose 30. Adjacent to the annular end face 42 is provided an annular retainer plate 43 sealingly sleeved onto the hose 30 and an annular clamp member 44 for clamping sealing rings 45, which is held by the annular retainer plate 43, against the end face 42 of the tubular member 41, thereby preventing the gas slow through the annular end face 42. To the tubular wall of the tubular member 41 are attached three pipes 41*a* branching in a T-shape, as better shown in FIG. 16, for communicating the inside of the tank 2 and the double-pipe 26. Since the double-pipe 26 is provided with three branching pipes 41*a*, at least one branching pipes 41*a* can be communicated with the space occupied by the gas during rotation of the tank 2 so that the gas generated in the tank can be sent out or the inert gas can be sent in through the double-pipe 26.

Figure 17:
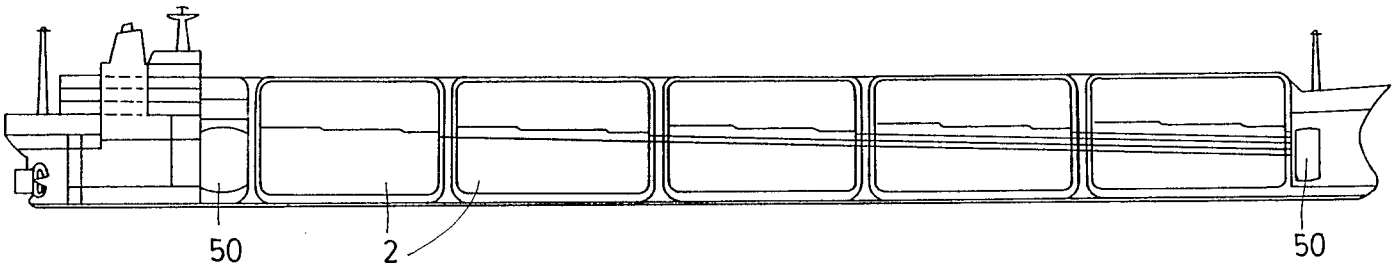
FIG. 17 is a schematic elevation view of the tanker.
Figure 18:
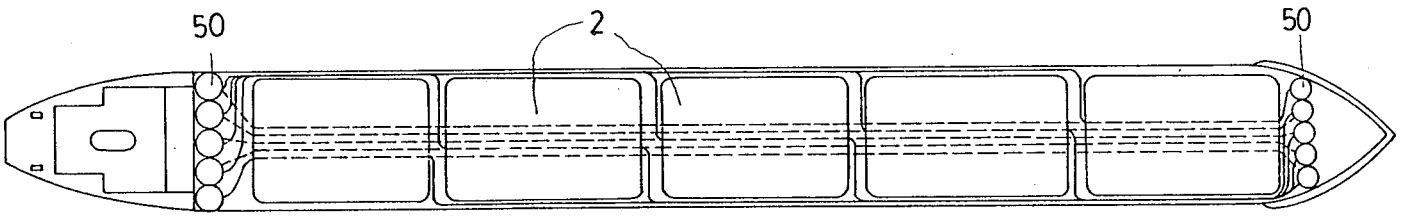
FIG. 18 is a schematic plan view of the tanker.

Referring to FIGS. 17 and 18, there are further provided 10 auxiliary cargo tanks 50 at the stern portion and the prow portion of the ship. The number of the auxiliary tanks 50 corresponds to the number of the compartments of the tanks 2. Each main cargo pipe 24 is connected to the relative auxiliary tanks 50 and the relative compartment of the tanks 2, and then connected to the pumping system by means of a three-way valve. Five auxiliary tanks 50 are connected to five compartments which contains the cargo to be unloaded, and another five auxiliary tanks 50 are connected to another five compartments which will receive the cargo to be loaded.

In operation, it is first necessary to balance the stern portion and the prow portion by unloading the cargo from five auxiliary tanks until one half of the content is left in each auxiliary tank 50 and by loading another cargo into another five auxiliary tanks 50 until the content in each tank 50 reaches one half of the tank volume. Second, the loading and unloading operations are done in the tanks 2, and finally, the five auxiliary tanks 50 are filled with the additional cargo and the other five auxiliary tanks 50 are emptied.

Figure 15:
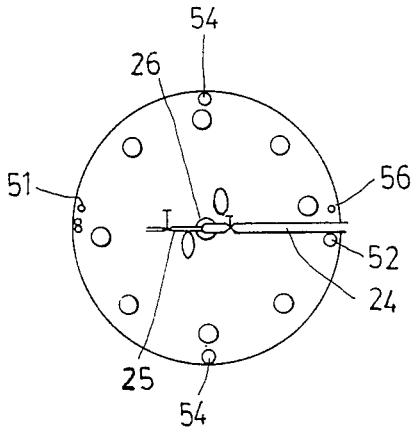
FIG. 15 is a side elevation view of the tank of FIG. 14.

Referring again to FIG. 14, the main gas pipe 25 which is connected to the tank 2 through the double-pipe 26 is further connected to the relative auxiliary tank 50 from which the gas is conveyed to a mast for venting gas. The main gas pipe 25 is further connected to a branch pipe 25*a* through which an inert gas can be supplied. Each tank 2 is further provided with deflating valves 51 of which the position relative to the tank is shown in FIG. 15. They are in connection with PV valves (not shown) to regulate the pressure in the tank.

Figure 19:
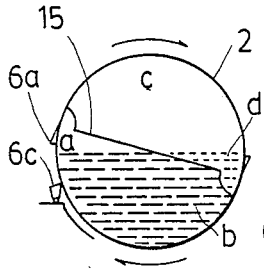
FIGS. 19 to 26 illustrate the loading and unloading operation with the tank having two compartments of equal volume.
Figure 20:
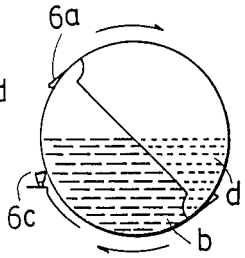
Figure 21:
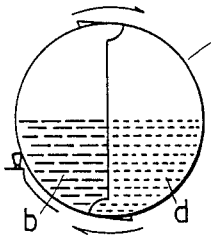
Figure 22:
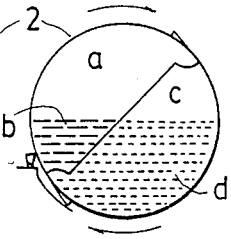
Figure 23:
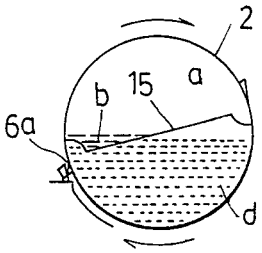
Figure 24:
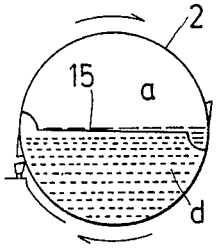
Figure 25:
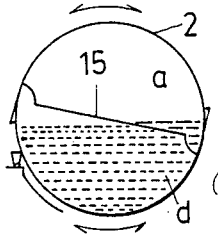

The loading and unloading operations in a tank 2 having equal volume compartments is hereinunder described with reference to FIGS. 18 through 26. The letter a represents the compartment of the tank 2 which contains a liquid cargo b to be loaded and the letter c represents the compartment for receiving a new liquid cargo d. The liquid d is drawn into the compartment c simultaneously with the discharge of the liquid b. It can be seen from FIG. 14 that the entering liquid d from the hose 30 fills the recessed surface 16*b* and then flows into the concaved portion 16*b* through a path 16*c*. When the liquid d fills the concaved portion 16*a* of the partition member 15, as shown in FIG. 19, a torque is produced which rotates the cylindrical tank 2, causing the inclined tooth 6*a* to disengage from the pawl 6*c*. When the tank 2 is rotated about an angle of 135 degrees, as shown in FIG. 22, a large portion of the liquid d has been discharged out. Upon further rotation of the tank 2, the inclined tooth 6*a* contacts with the pawl 6*c* as shown in FIG. 23, causing the sensing device to produce a warning signal for decreasing the discharging rate. When the tooth 6*a* passes the pawl 6*c*, as shown in FIG. 24, the partition member 15 is in its horizontal position and at this moment, the pumping operation is stopped. The cylindrical tank 2 is rotated by a hydraulic apparatus (not shown), which drives a gear (not shown) that is put into mesh with the peripheral gear 5 of the tank, to a position as shown in FIG. 25, wherein the remaining liquid d is collected in the concaved portion 16*a* of the partition member 15 and is drained out through a bottom drain valve 52 of which the location is shown in FIG. 15. The drain valve 52 is connected to the main cargo pipe 24 through a branch pipe 52*a* and is located at the cylindrical wall of the tank 2 adjacent to the concaved portion 16 of the partition member 15. Since the partition mamber 15 is slightly inclined downward at one of its end adjacent to the closed end of the tank 2, the liquid d can be completely drained out.

Figure 26:
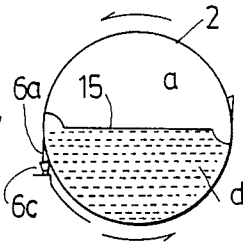

After the compartment c is emptied, the liquid b is continuously drawn into the compartment a and the partition member 15 is returned to a horizontal position, as shown in FIG. 26, causing the inclined tooth 6*a* to engage with the pawl 6*c* again. The hydraulically operated catching member 20 is then put into mesh with the locking gear portion 5*a* of the gear 5 for effectively locking the tank 2 against movement. If the liquid b is a volatile substance, an inert gas should be introduced into the compartment 2, through the gas pipe 25 and the double-pipe 26 for providing an inert gas atmosphere in the compartment.

Figure 27:
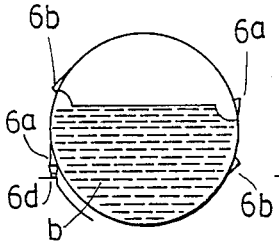
FIGS. 27 to 34 illustrate the loading and unloading operation with the tank having two compartments of unequal volume.
Figure 28:
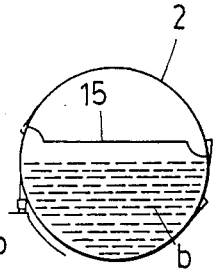
Figure 29:
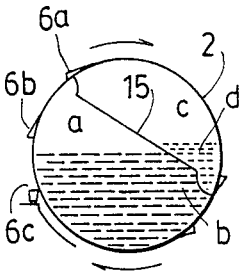
Figure 30:
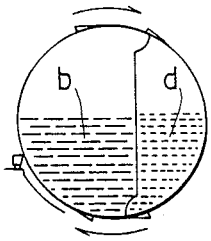
Figure 31:
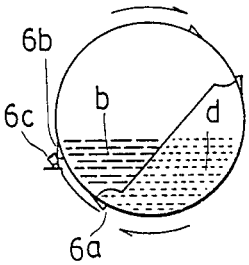
Figure 32:
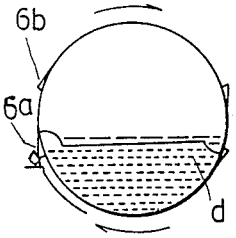
Figure 33:
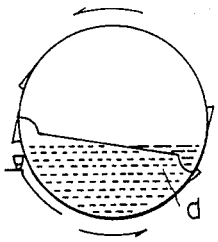
Figure 34:
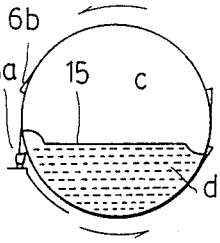

If the compartment a is larger in volume than the compartment c, the loading and unloading operations are illustrated in FIGS. 27 through 34. In this case, the ratchet assembly 6 of the tank 2 should includes two inclined teeth 6*a* and two inclined teeth 6*b* while in the case illustrated with reference to FIGS. 19 to 26, the ratchet assembly 6 only requires two inclined teeth 6*a*. In operation, a portion of the liquid b must be initially discharged and the loading of the liquid d is started afterwards, as shown in FIGS. 27 and 28. When the tank 2 is rotated to a position as shown in FIG. 31, the inclined tooth 6*b* comes into contact with the pawl 6*c* and the sensing device produces a signal to reduce the discharging rate. When the inclined tooth 6*a* passes the pawl 6*c*, as shown in FIG. 32, the partition member 15 is in a horizontal position and, at this moment, the loading and unloading operations are stopped. The remaining liquid d is completely discharged out as shown in FIGS. 33 and 34 in the same way as mentioned with reference to FIGS. 25 and 26.

Referring again to FIG. 4, there are further provided auxiliary cargo pipes 53 lying in the spaces defined by the ribs 8 below the tanks for interconnecting the tanks 2 and auxiliary tanks 50. The auxiliary pipes 53 are used when the cargo is not liquid or used temporarily to send out the cargo when the main cargo pipe 24 is damaged. They are connected to the tanks 2, when the tanks 2 are not rotated, through valves 54 of which the location is shown in FIG. 15.

Main cargo pipes 24 are disposed on two sides of the tanks 2, as shown in FIG. 4. There are further provided high pressure washing pipes 55 disposed on two sides of the tanks 2 and are connected to tanks 2, when the tanks are not rotated, through valves 56 of which the location is shown in FIG. 15. Since the tanks are cylindrical and rotatable and the partition member is slightly inclined and provided with the concaved portion 16*a*, the washing fluid after use can be entirely drained out without any residual remaining in the tank as the conventional rectangular tanks. The tanks 2 may be further provided with heat circulating pipes for heating liquid cargo, such as molasses, coal tar etc.

The tank can also be used for carrying powdered products and grain. When the tank 2 is used for holding a powdered product or grain, the auxiliary cargo pipe 53 must be connected to the tank to sent the cargo into or out of one compartment. In this cases, there will not result in a torque in the tank like the handling a liquid cargo.

With the invention thus explained, it is apparent that various modifications and variations can be made without departing from the scope of the invention. It is therefore intended that the invention be limited as indicated in the appended claims.

I claim:

1. In a ship including a hull of semicircular cross-section, an assembly for holding cargo mounted on the ship, cargo pipes for sending cargo into or out of said assembly and gas pipes for sending gases into or out of said assembly, said assembly comprising:

a cylindrical tank mounted for rotation about a horizontal axis in said hull and having two closed ends and an inside torque partition member dividing said tank into a lower compartment and an upper compartment; said torque partition member producing a torque during loading and unloading the liquid cargo;

rotating rail means provided around the periphery of said rotatable tank;

support rail means mounted on said hull for supporting said rotating rail means;

means for locking said tank against movement; and two connecting means for respectively connecting said two compartments to said cargo pipe and said gas pipe attached to two closed ends of said tank, each of said means including a double pipe assembly which has an outer pipe and an inside pipe with an annular space therebetween, and has its first end attached to the closed end for rotation together with said tank, the annular space between said outer pipe and said inside pipe used for the flow of the gas, and said inside pipe used for the flow of the liquid cargo, said double pipe assembly having its second end movably connected with said cargo pipe and gas pipe in a gas-tight relationship.

2. The assembly for holding cargo as claimed in claim 1, wherein said connecting means further includes: a support provided adjacent to one of said closed ends of said tank for supporting the second end of said double pipe in a movable position, and a hose placed in said tank and having its one end inserted in said inside pipe at said first end of said double pipe assembly in a movable and fluid-tight relationship, said inside pipe being sleeved onto said liquid cargo pipe in a movable and fluid-tight relationship at the second end of said double pipe assembly.

3. The assembly for holding cargo as claimed in claim 2, wherein said first end of said double pipe assembly is provided with three branch pipes branching radially in a plane close to the closed end of said tank for communicating the annular space of said double pipe and the inside of said tank.

4. The assembly for holding cargo as claimed in claim 3, in which said double pipe assembly includes an annular member sealingly sleeved onto said cargo pipe which is inserted in said inside pipe at said second end of said double pipe assembly, said annular member being connected to said double pipe assembly in such a manner that said double pipe assembly is movable relative to said annular member and said annular member sealingly closing the annular space of said double pipe assembly, wherein said gas pipe is connected to said annular member to be in a gas-tight communication relationship with the annular space of said double pipe assembly.

5. The assembly for holding cargo as claimed in claim 1, in which said rotating rail means includes at least one pair of rotating rails around said tank and said support rail means includes at least one pair of arc-shaped support rails provided on said hull, bolt members for fastening said support rails transversely passing through said support rails at intervals, and guide rollers rotatable about vertical axes provided between said support rails at certain intervals, wherein said support rails are provided with a plurality of recesses on their surfaces which are in contact with said rotating rails, and a plurality of rollers which are rotatable about horizontal axes and received in said recesses for providing rotating contact surfaces between said support rails and said rotating rails.

6. The assembly for holding cargo as claimed in claim 1, further comprising a ring gear provided around the periphery of said tank, a hydraulically operated drive means for driving said tank associated with said ring gear.

7. The assembly for holding cargo as claimed in claim 1, wherein said locking means includes a mechanism having a ratchet and a pawl, and a hydraulically operated catching means which includes a toothed member for engaging with a portion of said ring gear.

8. The assembly for holding cargo as claimed in claim 7, wherein said pawl and said hydraulically operated catching means are located on two opposite sides of said tank.

9. The assembly for holding cargo as claimed in claim 1, wherein said torque partition member is slightly inclined downward from one end to another end of said tank and includes two concaved portions respectively at its two opposite sides adjacent to the cylindrical wall of said tank to define a channel extending from one closed end to another closed end of said tank.

10. The assembly for holding cargo as claimed in claim 9, said torque partition member further includes two recesses respectively at its two opposite ends adjacent to said closed ends of said tank for receiving said hose connected to said double pipe, said recesses being communicated with said concaved portions respectively.

11. The assembly for holding cargo as claimed in claim 1, wherein said tank further includes a plurality of intersecting wash plates which define a plurality of compartments mounted to the upper side and the lower side of said partition member.

12. The assembly for holding cargo as claimed in claim 1, wherein said tank further includes pairs of intersecting beams of H-shaped cross-section attached to the inner side of the wall of said tank for reinforcement.

13. The assembly for holding cargo as claimed in claim 1, wherein said tank further includes a bottom drain valve near said concaved portion of said partition member.

14. The assembly for holding cargo as claimed in claim 1, further comprising auxiliary non-rotatable tanks provided at the stern and the prow of the ship and respectively communicated to said upper and lower compartments.

* * * * *